US008726574B2

(12) United States Patent
Iwaki

(10) Patent No.: US 8,726,574 B2
(45) **Date of Patent: *May 20, 2014**

(54) DRAWING DEVICE

(75) Inventor: Junpei Iwaki, Mie (JP)

(73) Assignee: Sugatsune Kogyo Co., Ltd., Tokyo (JP)

( * ) Notice: Subject to any disclaimer, the term of this patent is extended or adjusted under 35 U.S.C. 154(b) by 318 days.

This patent is subject to a terminal disclaimer.

(21) Appl. No.: 13/011,466

(22) Filed: Jan. 21, 2011

(65) Prior Publication Data

US 2011/0203183 A1 Aug. 25, 2011

(30) Foreign Application Priority Data

Feb. 24, 2010 (JP) ..... 2010-038301

(51) Int. Cl.
*E05D 13/00* (2006.01)

(52) U.S. Cl.
USPC ..... 49/414; 49/138; 16/49

(58) Field of Classification Search
USPC ..... 49/409, 410, 411, 324, 347, 414, 138, 49/139, 140; 16/49, 51, 52, 53, 61, 62, 63, 16/64, 65, 71, 78, 79, 80, 72, 75, 76, 82, 16/83, 85
See application file for complete search history.

(56) References Cited

U.S. PATENT DOCUMENTS

| | | | | |
|---|---|---|---|---|
| 7,743,464 | B2 * | 6/2010 | Tomioka et al. | 16/64 |
| 7,874,597 | B2 * | 1/2011 | Tomita et al. | 292/137 |
| 7,980,640 | B2 * | 7/2011 | Yang | 312/333 |
| 8,123,313 | B2 * | 2/2012 | Morgan et al. | 312/405 |
| 8,151,413 | B2 * | 4/2012 | Iwaki | 16/96 R |
| 2008/0244862 | A1 * | 10/2008 | Tooyama | 16/82 |

FOREIGN PATENT DOCUMENTS

| | | |
|---|---|---|
| JP | 2006-200300 | 8/2006 |
| JP | 2008-285933 | 11/2008 |

* cited by examiner

*Primary Examiner* — Katherine Mitchell
*Assistant Examiner* — Catherine A Kelly
(74) *Attorney, Agent, or Firm* — Young & Thompson

(57) ABSTRACT

Provided is a drawing device that is capable of generating a damping force in accordance with the strength of a biasing force of an elastic member without increasing durability. The drawing device has a linear damper 24 of which a rod is extendable relative to a damper main body and a rotary damper 25 of which a rotation axis is rotatable relative to the damper main body. When a slider 14 of a drawing device main body 4 moves relative to a base 12 of the drawing device main body 4 in the longitudinal direction by the biasing force of the elastic member 15, first, the linear damper 24 starts to operate thereby generating the damping force, then, the linear damper 24 is switched with the rotary damper 25 and the rotary damper 25 starts to operate thereby generating the damping force.

3 Claims, 14 Drawing Sheets closing direction
1
2
4
5
5a
6
7
8
9
9a closing direction
5
17
14
16
6
12b
12b-1
12b-2
18
20
20a
19
21
14a
14a-1
14a-2
14
12d
12a
12
12c
26
15
24c
24
24b
24a
22
25
25a
25b
27

FIG.8A
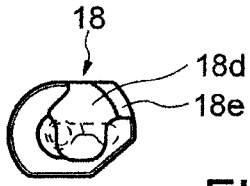
FIG.8D
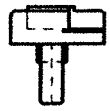
FIG.8B
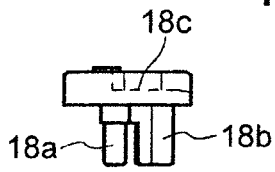
FIG.8C
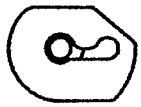
FIG.9A
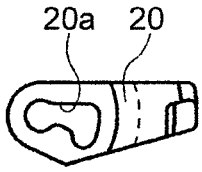
FIG.9C
FIG.9B
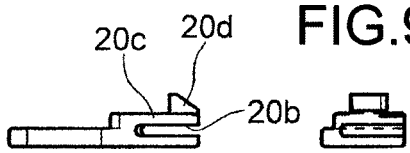
closing direction FIG.16(1-1)
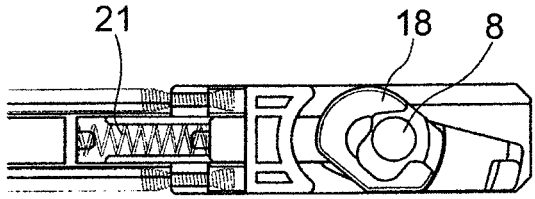
FIG.16(1-2)
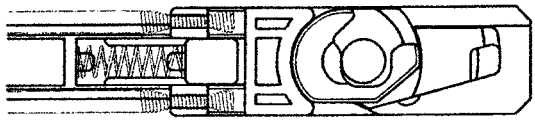
FIG.16(2-1)
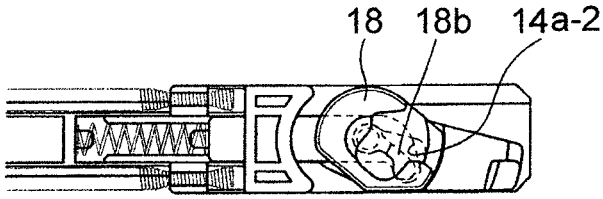
FIG.16(2-2)
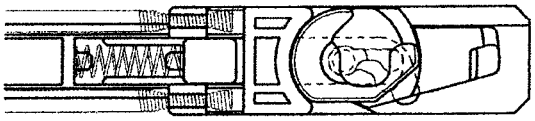
FIG.16(3-1)
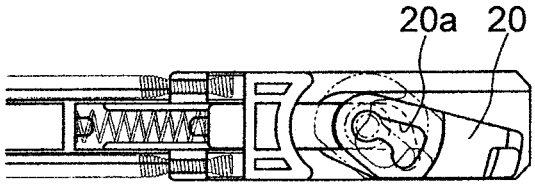
FIG.16(3-2)
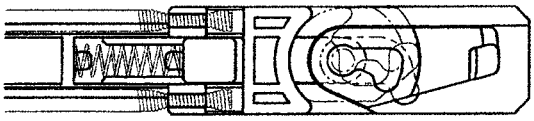
FIG.16(4-1)
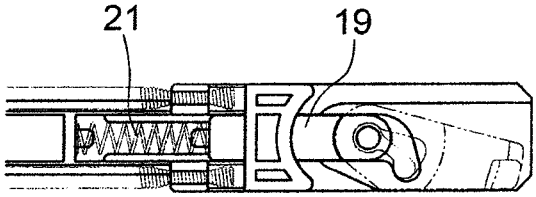
FIG.16(4-2)
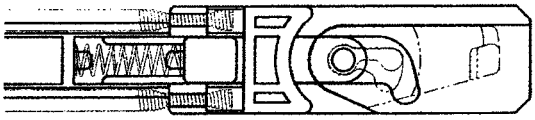

DRAWING DEVICE

BACKGROUND OF THE INVENTION

1. Field of the Invention

The present invention relates to a drawing device that generates a force for assisting manual one-way movement of an opening/closing body such as a sliding door, a folding door or a drawer.

1. Related Art

A sliding door is sometimes provided with a drawing device that generates an assisting force in a closing direction for the sliding door that moves in the closing direction. A typical drawing device is called a self-closing device, and when the sliding door is moved manually along the guide rail in the closing direction and reaches a certain point, a biasing force in the closing direction by the elastic member is exerted on the sliding door. Then, the sliding door moves automatically in the closing direction and stops at a fully closed position (see, for example, Japanese Patent Application Laid-open No. 2008-285933).

On an upper part of a frame, a guide rail is attached that extends in the moving direction of the sliding door. The drawing device is held in the guide rail and can slide in the longitudinal direction of the guide rail by rollers. The sliding door suspends from the drawing device. When the sliding door is pushed manually and moved in the closing direction, the drawing device also moves in the closing direction. There is a pin fixed to the guide rail. When the drawing device moves in the closing direction and reaches a predetermined position, a slider of the drawing device catches the pin. Then, lock between the slier and a base of the drawing device is released and the base moves in the closing direction toward the slider by the elastic member of the drawing device. As the slider holds the pin, it does not move, and hence, the base moves in the closing direction. As the sliding door suspends from the base of the drawing device, the sliding door moves in the closing direction in accordance with movement of the base in the closing direction.

In order to prevent strong collision of the sliding door against the frame or door stop by the biasing force of the elastic member, the drawing device is provided with a damper. In the Japanese Patent Application Laid-open No. 2006-200300, there are two rotary dampers provided in the drawing device, which generate damping forces in accordance with the strength of the biasing force of the elastic member thereby to smooth movement of the sliding door. That is, at the initial operation time when a large biasing force acts on the drawing device, the two rotary dampers are operated to increase the damping forces, and immediately before the sliding door is closed with a small biasing force that acts on the drawing device, one of the rotary dampers is operated to reduce the damping force.

In the drawing device as disclosed in Japanese Patent Application Laid-open No. 2006-200300, on a drawing frame of the drawing device, the two rotary dampers are mounted with a space created therebetween in the longitudinal direction, and the rotary dampers have pinions. The guide rail mounted on the frame has a rack. When an operating member mounted on the sliding door operates a catch member, a pulling coil spring operates to move the drawing frame in the closing direction relative to the guide rail, and at the same time, the pinions move on the rack. Then, the rotary dampers rotate, and a predetermined damping force can be obtained. When the drawing frame moves further, the first pinion gets out of the rack, the damping force is reduced accordingly and the sliding door closes smoothly.

In the above-mentioned drawing device, the two rotary dampers are aligned in the moving direction of the sliding door in order to obtain predetermined damping performance. It is necessary for one of the rotary dampers which is positioned to the closing side of the sliding door to have high durability since it is operated constantly from the time when the drawing device starts to the time when the sliding door is closed completely.

Then, the present invention has an object to provide a drawing device that is capable of generating a damping force in accordance with the strength of a biasing force of the elastic member without increasing the durability.

BRIEF SUMMARY OF THE INVENTION

In order to solve the above-mentioned problems, an aspect of the present invention is a drawing device for giving a biasing force in one direction to an opening/closing body movable relative to a frame when the opening/closing body moves in the one direction, comprising: a trigger pin which is attached to one of the frame and the opening/closing body; and a drawing device main body which is attached to an other of the frame and the opening/closing body and provided for catching the trigger pin to give the opening/closing body the biasing force in the one direction, the drawing device main body having a base which is attached to the other of the frame and the opening/closing body and elongates in a moving direction of the opening/closing body, a slider which has a trigger catcher capable of catching the trigger pin and is slidable relative to the base in a longitudinal direction while the trigger catcher catches the trigger pin, an elastic member which spans the base to the slider, gives the biasing force so as to move the slider relative to the base in the longitudinal direction and thereby gives the biasing force in the one direction to the opening/closing body, and a damper mechanism which generates a damping force when the slider moves relative to the base in the longitudinal direction by the biasing force of the elastic member, the damper mechanism having a linear damper with a rod extendable relative to a damper main body, and a rotary damper with a rotation axis rotatable relative to the damper main body, in which when the slider moves relative to the base in the longitudinal direction by the biasing force of the elastic member, first the linear damper operates to cause the damping force, then, the linear damper is switched to the rotary damper and the rotary damper operates to cause the damping force.

According to the present invention, the linear damper is first operated for generating a relatively large damping force, and then, the damper is switched to the rotary damper, which is operated for generating a relatively small damping force. With this structure, it is possible to generate the damping forces in accordance with the strength of an elastic force of the elastic member. As the two dampers operate one by one from start to finish of the operation of the drawing device, it is not necessary to increase the durability of the dampers. Further, if the rotary damper is used to increase the damping force, the rotary damper needs to have a larger diameter and there arises a problem that the drawing device cannot be accommodated in the narrow guide rail and the design freedom of the drawing device is limited. However, according to the present invention, as the elongating and extendable linear damper is used, the drawing device can be accommodated in the narrow guide rail.

BRIEF DESCRIPTION OF THE SEVERAL VIEWS OF THE DRAWINGS

The above and other objects and features of the invention will appear more fully hereinafter from a consideration of the following description taken in connection with the accompanying drawing wherein one example is illustrated by way of example, in which;

(FIG. 1A is a plan view, FIG. 1B is a side view and FIG. 1C is a front view);

(FIG. 2A is a cross sectional view of the guide rail at the position of a trigger pin, FIG. 2B is a cross sectional view of the guide rail at the position of a countersunk screw, FIG. 2C is a cross sectional view of the guide rail taken along the longitudinal direction, and FIG. 2D is a front view thereof);

(FIG. 3A illustrates the drawing device main body assembled and FIG. 3B illustrates main parts of the drawing device main body disassembled);

(FIG. 4A illustrates the drawing device main body assembled and FIG. 4B illustrates main parts of the drawing device main body disassembled);

(FIG. 5A is a plan view, FIG. 5B is a side view and FIG. 5C is a cross sectional view);

(FIG. 6A is a plan view, FIG. 6B is a side view, FIG. 6C is a bottom view, FIG. 6D is a cross sectional view, FIG. 6E is a left-side front view, and FIG. 6F is a right-side front view);

(FIG. 7A is a plan view, FIG. 7B is a side view, FIG. 7C is a left-side front view, and FIG. 7D is a right-side front view);

FIGS. 8A to 8D illustrate a trigger catcher (FIG. 8A is a plan view, FIG. 8B is a side view, FIG. 8C is a bottom view, and FIG. 8D is a right-side front view);

FIGS. 9A to 9C illustrate a malfunction reset cam (FIG. 9A is a plan view, FIG. 9B is a side view, and FIG. 9C is a right-side front view);

(FIG. 10A is a plan view, FIG. 10B is a side view, FIG. 100 is a left-side front view and FIG. 10D is a right-side front view);

(FIG. 11A is a plan view, FIG. 11B is a side view, and FIG. 11C is a left-side front view);

(FIG. 13A is a plan view, FIG. 13B is a side view, and FIG. 13C is a left-side front view);

(FIG. 14A illustrates the drawing device when the drawing operation starts, FIG. 14B illustrates the drawing device when the dampers are switched, and FIG. 14C illustrates the drawing device when the sliding door that is fully closed);

(FIG. 15A illustrates the drawing device when the drawing operation starts, FIG. 15B illustrates the drawing device when the dampers are switched, and FIG. 15C illustrates the drawing device when the sliding door is fully closed);

FIGS. 16(1-1) to 16(4-2) are detail views in which the trigger catcher 18 rotates to allow sliding;

(FIG. 17A illustrates the drawing device when the sliding door is fully closed, FIG. 17B illustrates the drawing device when the sliding door starts to open, FIG. 17C illustrates the drawing device when the damper lock fits in the lock hole of the base, and FIG. 17D illustrates the drawing device when the damper base moves integrally with the base); (FIG. 18A illustrates the drawing device when the sliding door is fully closed, FIG. 18B illustrates the drawing device when the sliding door starts to open, FIG. 18C illustrates the drawing device when the damper lock fits in the lock hole of the base, and FIG. 18D illustrates the drawing device when the damper base moves integrally with the base).

DETAILED DESCRIPTION OF THE INVENTION

Figures 1A, 1B, 1C:
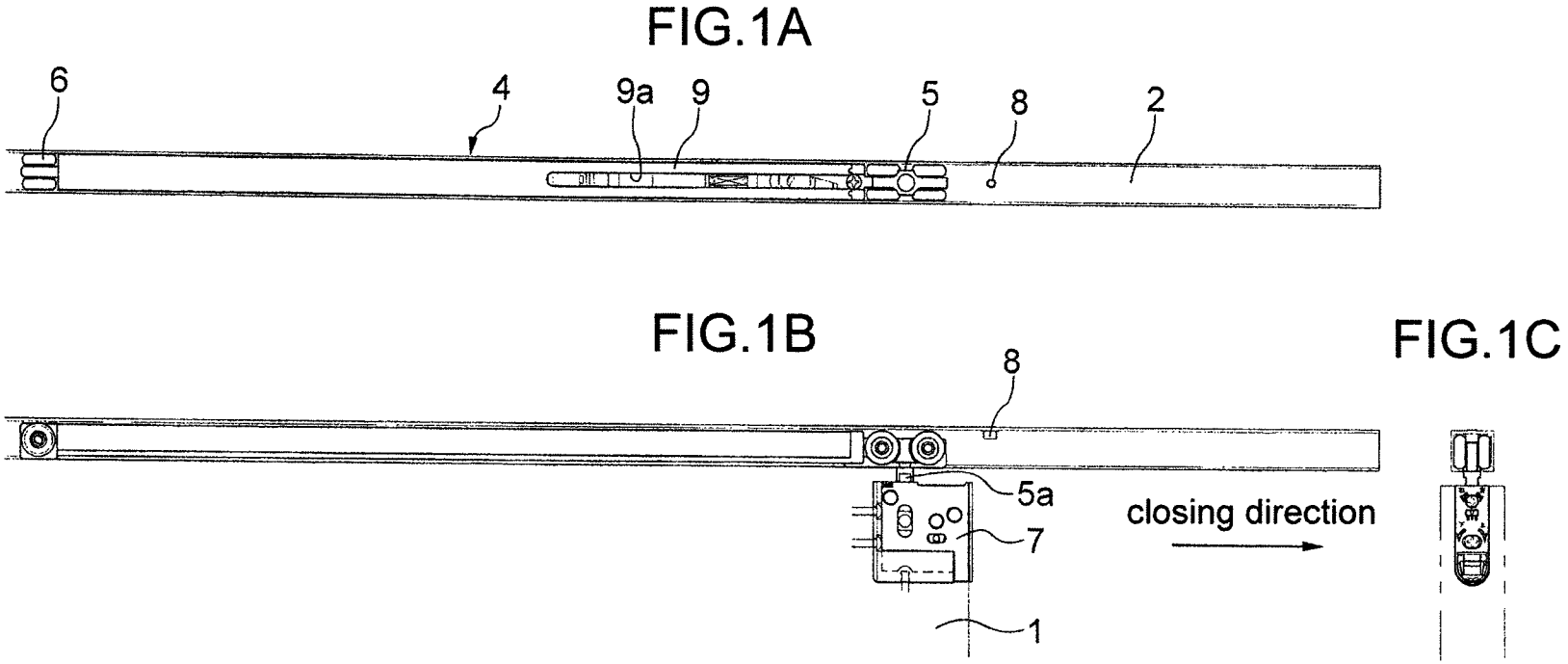
FIGS. 1A to 1C are outline views of a drawing device according to an exemplary embodiment of the present invention
Figure 2A:
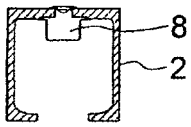
FIGS. 2A to 2D are detail views of a guide rail
Figure 2B:
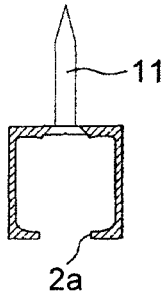
Figure 2C:
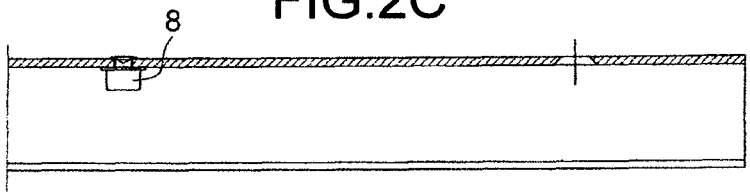
Figure 2D:
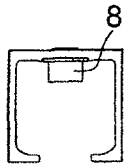

With reference to the drawings, an exemplary embodiment of the present invention will be described below. FIGS. 1A to 1C are outline views of a drawing device. On the top frame of a sliding door 1, a guide rail 2 is fixed that extends in the moving direction of the sliding door 1. A drawing device main body 4 also elongating is inserted into the guide rail 2 and can move smoothly in the guide rail 2 by door rollers 5 and 6 which are provide at the longitudinal-direction respective ends of the drawing device main body 4. The sliding door 1 suspends from the drawing device main body 4. The drawing device main body 4 moves in the guide rail 2 in conjunction with movement in opening and closing directions of the sliding door 1. The sliding door 1 is connected to the door roller 5 via a position adjusting unit 7. The position in the vertical direction and width direction of the sliding door 1 relative to the drawing device main body 4 can be adjusted by the position adjusting unit 7.

The guide rail 2 has a trigger pin 8. This trigger pin 8 is fixed at the position where the sliding door 1 moves in the closing direction and the drawing device main body 4 starts to operate. There is a cover 9 of the drawing device main body 4 and the cover 9 has a slit 9*a* formed to receive the trigger pin 8 when the drawing device main body 4 moves toward the trigger pin 8.

FIGS. 2A to 2D are detail views of the guide rail 2. The guide rail 2 has an approximately rectangular cross section and is fixed to the frame by a countersunk screw 11. At the ceiling part of the guide rail 2, the trigger pin 8 is fixed projecting in the guide rail 2. At the bottom part of the guide rail 2, a slit 2*a* is formed the entire length of the guide rail 2 in the longitudinal direction. The door rollers 5 and 6 of the drawing device main body 4 roll on the upper surface of the bottom part of the guide rail 2. There is a connecting shaft 5*a* (see FIG. 1) that projects from the door rollers 5 and 6 via the slit 2*a* for connecting the door rollers 5 and 6 to the sliding door 1.

Figures 3A, 3B:
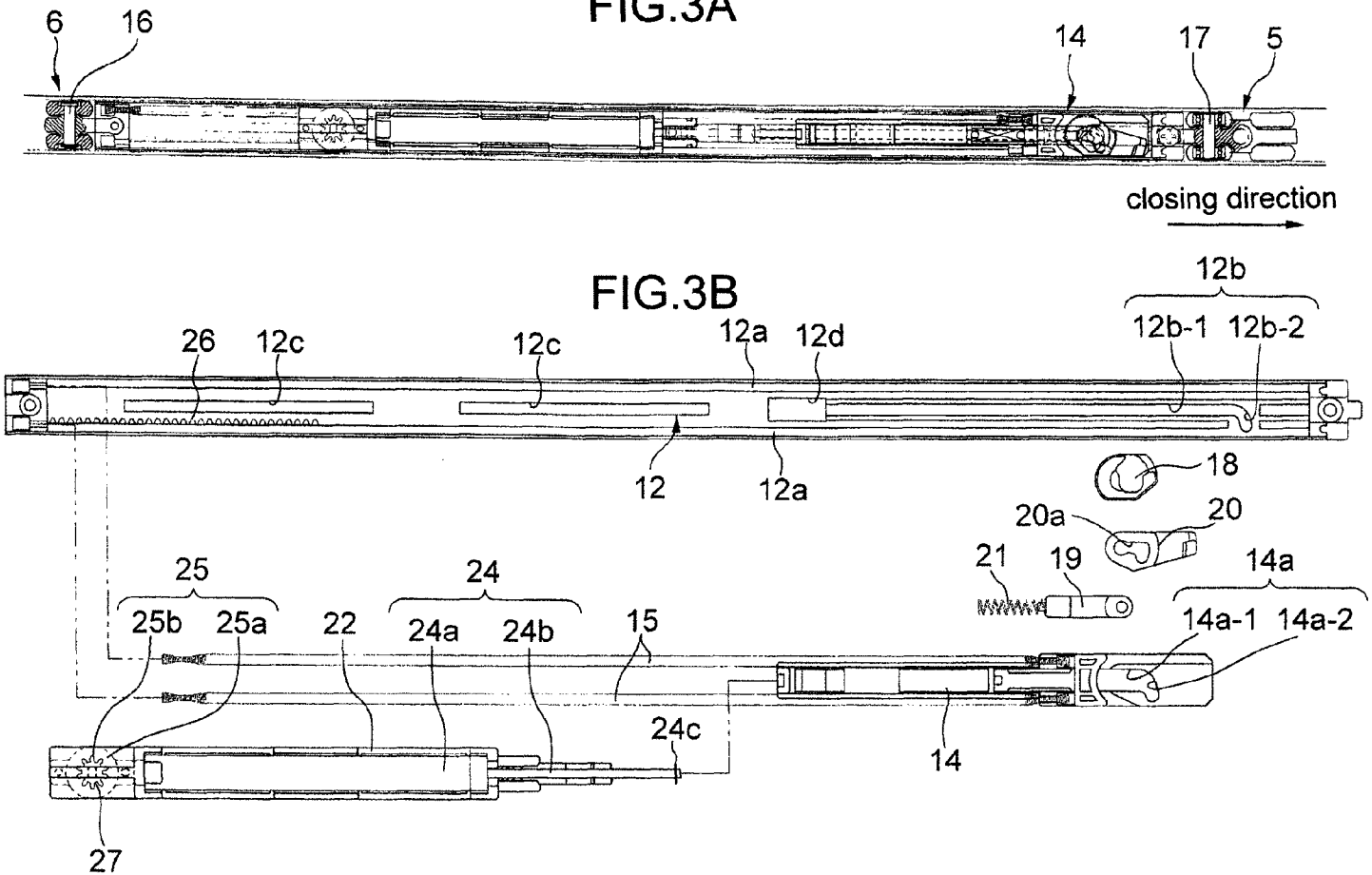
FIGS. 3A and 3B are plan views of a drawing device main body
Figure 4A:
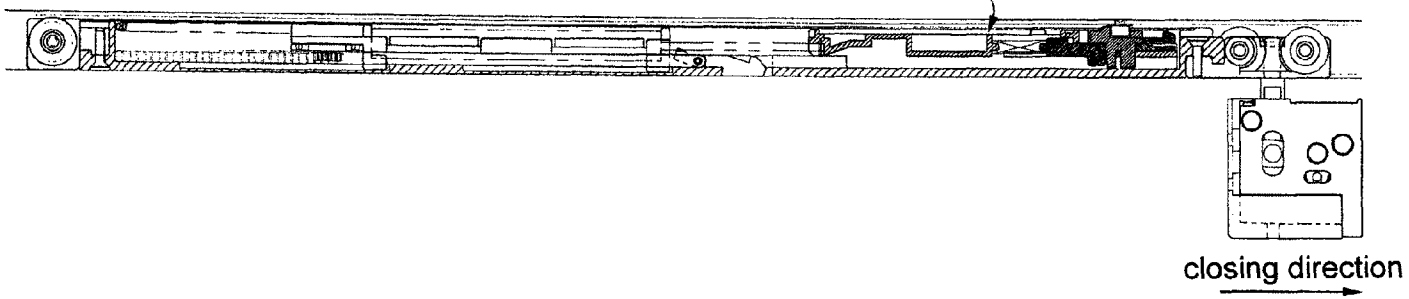
FIGS. 4A and 4B are cross sectional views of the drawing device main body
Figure 4B:
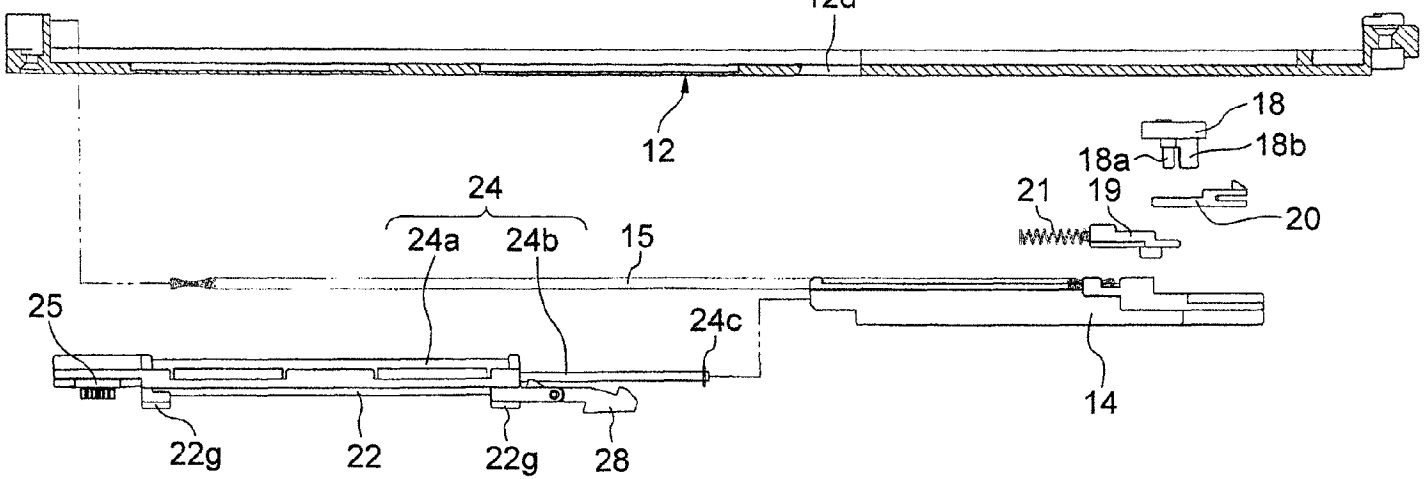

FIGS. 3A to 4B are detail views of the drawing device main body 4. FIGS. 3A and 3B are plan views of the drawing device main body 4 and FIGS. 4A and 4B are vertical cross sectional views of the drawing device main body 4. FIGS. 3A and 4A illustrate the drawing device main body 4 assembled and FIGS. 3B and 4B illustrate the drawing device main body 4 of which main parts are disassembled. The drawing device main body 4 has a base 12 elongating in the longitudinal direction of the guide rail 2 and a slider 14 which is slidable in the longitudinal direction relative to the base 12.

As illustrated in FIGS. 3A and 3B, the rotation axes 17, 16 of the door rollers 5 and 6 are fixed at the respective ends of the base 12 in the longitudinal direction and the door rollers 5 and 6 are rotatable on the rotation axes 17, 16. In the base 12, a pair of side walls 12*a* is formed at the respective sides of the base 12 in the width direction for guiding the slider 14. A pulling coil spring 15 is provided over between the base 12 and the slider 14 as an elastic member. The slider 14 slides automatically in the base 12 by a biasing force of the pulling coil spring 15.

A trigger catcher 18 is mounted in the slider 14 for catching the trigger pin 8. The trigger catcher 18 is supported at the tip end in the closing direction of a trigger pusher 19 to be rotatable in the horizontal plane. A malfunction reset cam 20 is also supported by the trigger pusher 19 to be rotatable in the horizontal plane. A locking piece 18*b* (FIG. 4B) and a rotation axis 18*a* of the trigger catcher 18 pass through an opening 20*a* of the malfunction reset cam 20 and fit in a trigger catcher guide groove 12*b* formed in the base 12 and a trigger catcher guide slit 14*a* formed in the slider 14 to be slidable in the longitudinal direction. There is a compression coil spring 21 provided over between the trigger pusher 19 and the slider 14.

When the sliding door 1 is open, as illustrated in FIGS. 3A and 3B, the slider 14 is positioned at the lock position at the end in the closing direction of the base 12. In an area where the slider 14 operates in the bottom surface of the base 12, a trigger catcher guide groove 12*b* is formed, including a straight groove 12*b*-1 extending in the longitudinal direction and a locking groove 12*b*-2 bent to one side at the end in the closing direction of the straight groove 12*b*-1. When the locking piece 18*b* of the trigger catcher 18 is fit in the locking groove 12*b*-2, the slider 14 is locked. The trigger pusher 19 and the compression coil spring 21 hold the state in which the locking piece 18*b* of the trigger catcher 18 is fit in the locking groove 12*b*-2 and then hold the lock position of the slider 14. The malfunction reset cam 20 is provided to return the slider 14 to the lock position even if the lock of the slider 14 is released by malfunction.

Between the paired side walls 12*a* of the base 12, a damper base 22 is fitted therein slidably. In the bottom part of the base 12, a pair of damper base guide grooves 12*c* is formed separated in the longitudinal direction. The damper base 22 has a pair of leg parts 22*g* formed separated in the longitudinal direction. The paired leg parts 22*g* are fit into the damper base guide grooves 12*c*. The damper base 22 slides in the base 12 in the longitudinal direction as guided by the damper base guide grooves 12*c* and the paired side walls 12*a* of the base 12.

On the damper base 22, a linear damper 24 and a rotary damper 25 are fixed thereto. The linear damper 24 has a tubular damper main body 24*a* and a rod 24*b* extendable relative to the damper main body 24*a*. When the rod 24*b* contracts, there is generated a damping force. The rotary damper 25 has a disc-shaped damper main body 25*a* and a rotation axis 25*b* rotatable relative to the damper main body 25*a*. When the rotation axis 25*b* rotates, there is generated a damping force. The rotation axis 25*b* is connected to a pinion 27 integrally.

The damper main body 24*a* of the linear damper 24 and the damper main body 25*a* of the rotary damper 25 are connected to the damper base 22. The rod 24*b* of the linear damper 24 is connected to the slider 14. When the slider 14 moves relatively toward the damper base 22, there is generated a damping force of the linear damper 24. There is a rack 26 provided at the opposite side of the base 12 in the closing direction of the sliding door, and the pinion 27 of the rotary damper 25 engages with the rack 26. When the damper base 22 moves relatively toward the opposite end to the closing direction of the base 12, the rotary damper 25 rotates and there occurs a damping force.

As illustrated in FIGS. 4A and 4B, at the end of the damper base 22 in the closing direction, a damper lock 28 is attached thereto to be rotatable in the vertical plane. In the base 12, a lock hole 12*d* is formed as a damper lock engaging piece for engagement of the damper lock 28 therein. When the damper lock 28 fits in the lock hole 12*d* of the base 12, the damper base 22 is locked so that the damper base 22 cannot slide in the longitudinal direction relative to the base 12. When engagement between the damper lock 28 and the lock hole 12*d* of the base 12 is released, the damper base 22 comes to slide in the longitudinal direction relative to the base 12.

Next description is made about the structure of each part of the drawing device main body 4.

Figure 5A:
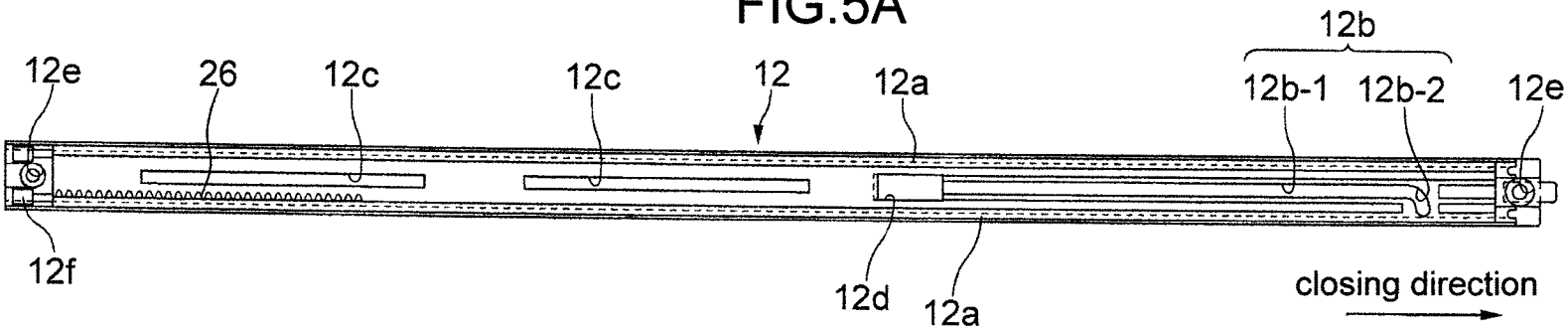
FIGS. 5A to 5C are views of a base
Figure 5B:
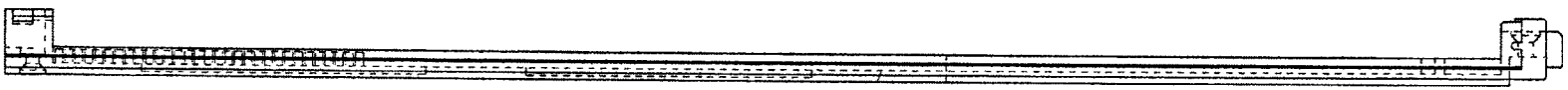
Figure 5C:
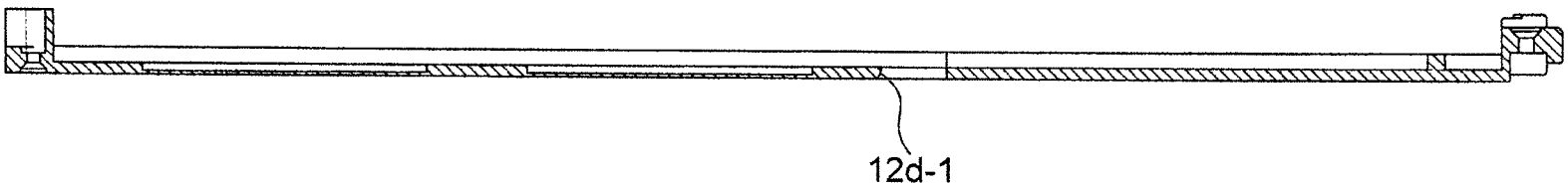
Figure 6A:
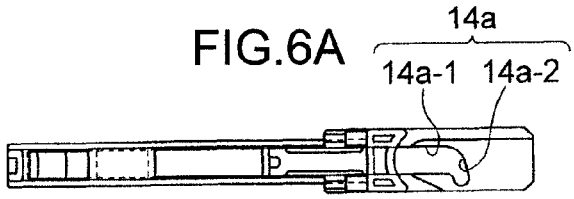
FIGS. 6A to 6F illustrate a slider
Figure 6E:
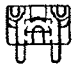
Figure 6B:
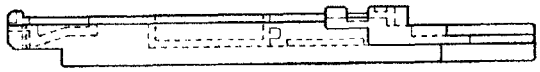
Figure 6F:
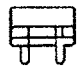
Figure 6C:
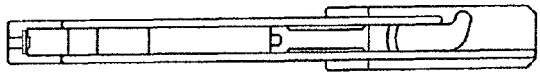
Figure 6D:
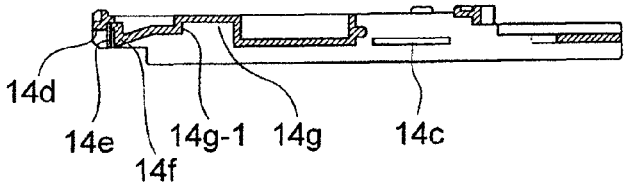
Figure 7A:
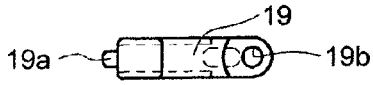
FIGS. 7A to 7D illustrate a trigger pusher
Figures 7B, 7C, 7D:
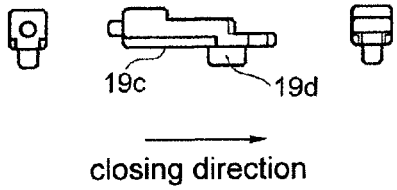
Figure 10A:
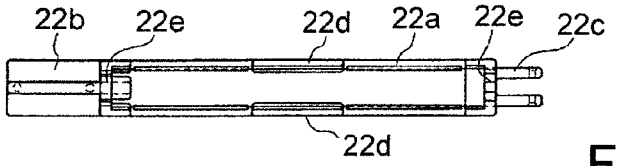
FIGS. 10A to 10D illustrate a damper base
Figure 10C:
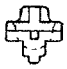
Figure 10B:
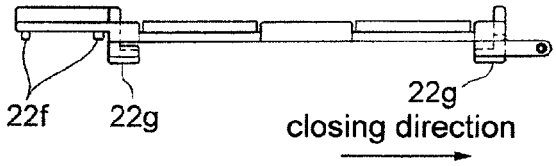
Figure 10D:
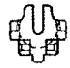

FIGS. 5A to 5C illustrate the base 12. The elongated base 12 has both ends in the longitudinal direction where connecting pieces 12*e* are formed as connected to the door rollers 5 and 6. At the end in the direction opposite to the closing direction of the base 12, a wall part 12*f* is formed to which an end of the pulling coil spring is connected. At both sides in the width direction of the base 12, the paired side walls 12*a* are formed. The paired side walls 12*a* guide sliding of the slider 14 in the longitudinal direction relative to the base 12 and guide sliding of the damper base 22 in the longitudinal direction relative to the base 12.

At the bottom part of the base 12 at the closing direction side, the trigger catcher guide groove 12*b* is formed having a straight groove 12*b*-1 extending in the longitudinal direction and a locking groove 12*b*-2 that is bent to the side at the end in the closing direction of the straight groove 12*b*-1. At this trigger catcher guide groove 12*b*, the locking piece 18*b* and the rotation axis 18*a* of the trigger catcher 18 are fit therein.

At the end in the direction opposite to the closing direction of the trigger catcher guide groove 12*b*, a rectangular-shaped lock hole 12*d* is formed as a damper lock engaging piece that engages with the damper lock. The side surface 12*d*-1 in the direction opposite to the closing direction of the lock hole 12*d* is inclined in such a manner that the lock hole 12*d* becomes larger at the bottom of the lock hole 12*d* than at the top of the lock hole 12*d*. This is because, as illustrated in FIGS. 4A and 4B, fitting of the damper lock 28 in the lock hole 12*d* is secured even when the slider 14 pushes the rod 24*b* of the linear damper 24.

At the bottom part of the base 12, a pair of damper base guide grooves 12*c* is formed separated in the longitudinal direction. The damper base guide grooves 12*c* are provided for guiding the damper base 22. On the side wall of the base 12, a rack 26 is formed.

FIGS. 6A to 6F are detail views of the slider 14. In the slider 14, a trigger catcher guide slit 14*a* is formed which has a straight slit 14*a*-1 extending in the longitudinal direction to the closing side and a locking slit 14*a*-2 bent to the side at the end in the closing direction of the straight slit 14*a*-1. This trigger catcher guide slit 14*a* corresponds to the trigger catcher guide groove 12*b* of the base 12 and passes through the slider 14 vertically. When the slider 14 reaches the lock position, the trigger catcher guide slit 14*a* and the trigger catcher guide groove 12*b* overlap each other. Then, the locking piece 18*b* of the trigger catcher 18 (see FIG. 4B) rotates in such a manner as to enter the locking groove 12*b*-2 of the trigger catcher guide groove 12*b* and the locking slit 14*a*-2 of the trigger catcher guide slit 14*a* (see FIG. 3B). As the compression coil spring 21 pushes the trigger pusher 10 in the closing direction, the locking piece 18*b* of the trigger catcher 18 is kept fit in the locking groove 12*b*-2 and the locking slit 14*a*-2 so that the slider 14 is maintained at the lock position.

In the slider 14, a guide bar 14*c* is formed for guiding the trigger pusher 19 to be slidable. In the slider 14, a projection 14*d* is formed which is fit inside the compression coil spring 21. At the end in the direction opposite to the closing direction of the slider 14, a connection slit 14*e* is formed which is connected to the tip end of the rod 24*b* of the linear damper 24.

As illustrated in FIG. 4B, a stop ring 24*c* is mounted on the tip end of the rod 24*b*. The stop ring 24*c* and the slider 14 are connected to each other by fitting the stop ring 24*c* on the connection slit 14*e*.

Figures 15A, 15B, 15C:
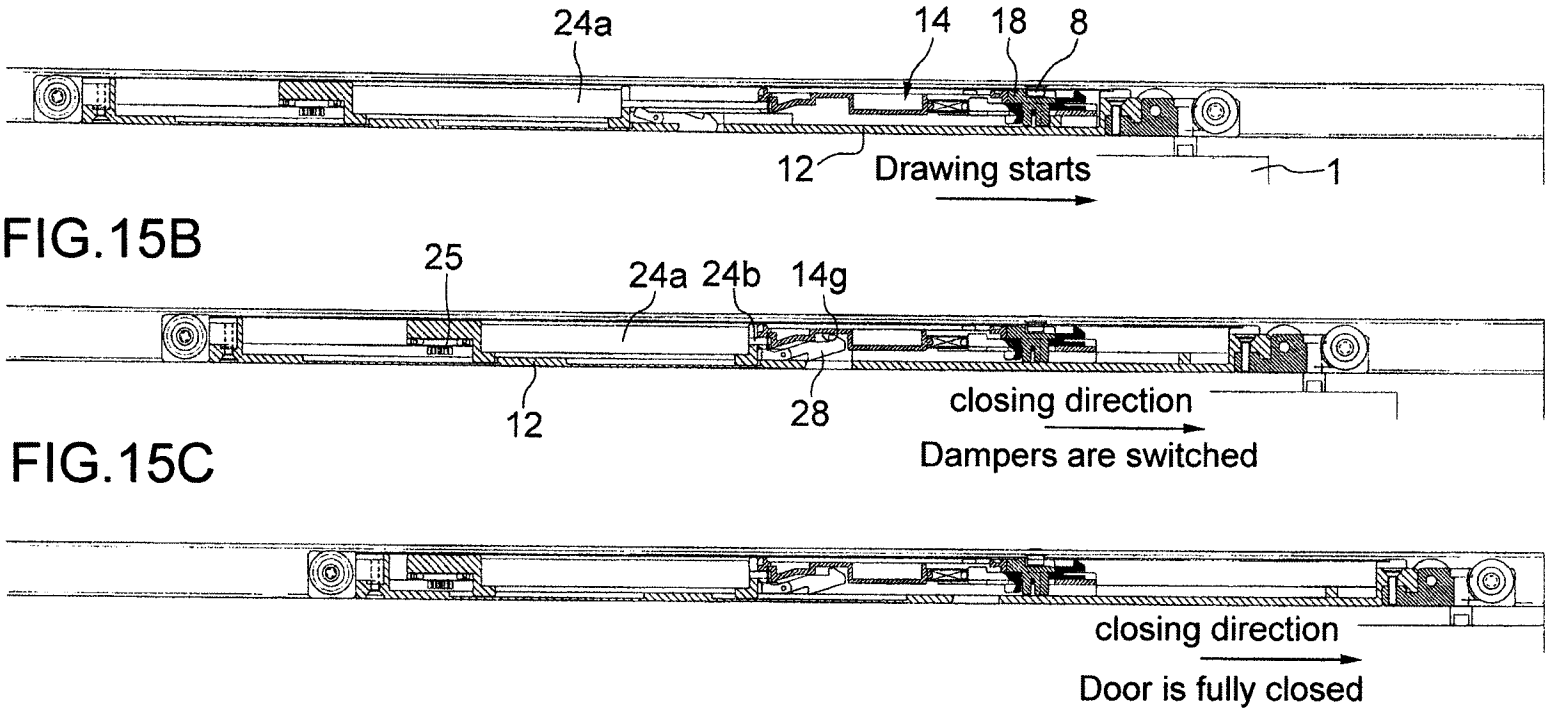
FIGS. 15A to 15C are cross sectional views for explaining the operation of the drawing device when the sliding door gets closed

As illustrated in FIGS. 6A to 6E, at the end in the direction opposite to the closing direction of the slider 14, an operation piece 14*f* is formed that abuts to the damper lock 28 to rotate the damper lock 28 (see FIG. 15B). In the bottom surface of the slider 14, a recess 14*g* is formed for allowing rotation of the damper lock 28 by the operation piece 14*f*.

FIGS. 7A to 7D illustrate the trigger pusher 19. At the end in the direction opposite to the closing direction of the trigger pusher 19, a projection 19*a* is formed that is fit inside the compression coil spring 21. At the end in the closing direction of the trigger pusher 19, a hole 19*b* is formed. In this hole 19*b*, the rotation axis 18*a* of the trigger catcher 18 is fit rotatably. At the bottom side of the trigger pusher 19, a guide groove 19*c* is formed which is guided by the guide bar 14*c* of the slider 14. Further, in the bottom surface of the trigger pusher 19, a projection 19*d* is formed that is fit in the straight groove 12*b*-1 of the base 12 slidably.

FIGS. 8A to 8D illustrate the trigger catcher 18. The trigger catcher 18 has a disc-shaped main body 18*c*, a rotation axis 18*a* projecting downward from the main body 18*c* and a locking piece 18*b* that is provided in adjacent to the rotation axis 18*a* under the main body. In an upper surface of the main body 18*c*, a trigger pin insert groove 18*d* is formed for inserting the trigger pin 8 therein. The trigger pin insert groove 18*d* is surrounded by a wall, in a part of which an inlet part 18*e* is formed for insertion of the trigger pin 8. The locking piece 18*b* and the rotation axis 18*a* of the trigger catcher 18 are fit in the trigger catcher guide groove 12*b* of the base 12.

FIGS. 9A to 9C illustrate the malfunction reset cam 20. Once it is fit in the trigger catcher 18, the malfunction reset cam 20 is supported rotatably, with the trigger catcher 18, by the trigger pusher 19. In the malfunction reset cam 20, a sector-shaped opening 20*a* is formed in which the locking piece 18*b* and the rotation axis 18*a* of the trigger catcher 18 are fit. This sector-shaped opening 20*a* is formed larger than the locking piece 18*b* and the rotation axis 18*a* of the trigger catcher 18 in such a manner that rotation of the trigger catcher 18 relative to the malfunction reset cam 20 can be allowed. At the end in the closing direction of the malfunction reset cam 20, a slit 20*b* is formed so that the malfunction reset cam 20 is branched into two vertically. On an upper piece 20*c*, a locking piece 20*d* is formed so as to catch the trigger pin 8.

When the slider 14 is away from the lock position due to malfunction, the inlet 18*e* of the trigger pin insert groove 18*d* of the trigger catcher 18 cannot accommodate the trigger pin 8. Therefore, even if the sliding door 1 is moved in the closing direction and the slider 14 is close to the trigger pin 8, the trigger catcher 18 cannot catch the trigger pin 8. Even in such a case, the upper piece 20*c* of the malfunction reset cam 20 is bent so that the locking piece 20*d* of the upper piece 20*c* catches the trigger pin 8. Therefore, the slider 14 can be reset to the lock position.

FIGS. 10A to 10D illustrate the damper base 22. The damper base 22 has a linear damper fixing part 22*a* where the damper main body of the linear damper 24 is mounted, a damper lock connection bracket 22*c* provided at the end in the closing direction of the linear damper fixing part 22*a* and a plate-shaped rotary damper fixing part 22*b* where the damper main body 25*a* of the rotary damper 25 is fixed at the side in the direction opposite to the closing direction of the linear damper fixing part 22*a*.

At both ends in the width direction of the linear damper fixing part 22*a*, a pair of claws 22*d* is provided bent inward. The damper main body 24*a* of the linear damper 24 is sandwiched between the paired claws 22*d* in the width direction. At respective ends in the longitudinal direction of the linear damper fixing part 22*a*, a pair of end walls 22*e* is formed between which the damper main body 24*a* is sandwiched in the longitudinal direction. The damper lock connection bracket 22*c* projects from the linear damper fixing part 22*a* in the closing direction. Connected to the damper lock connection bracket 22*c* is the damper lock 28 via a spring pin rotatably. The damper lock 28 is biased to the lock hole 12*d* of the base by the spring pin. At the bottom of the plate-shaped rotary damper fixing part 22*b*, a positioning projection 22*f* is formed for positioning the damper main body 25*a* of the rotary damper 25.

Figure 11A:
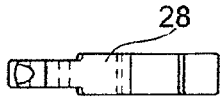
FIGS. 11A to 11C illustrate a damper lock
Figure 11C:
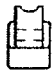
Figure 11B:
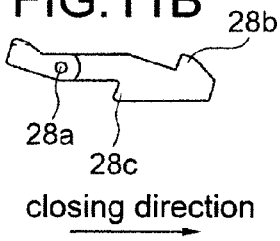

FIGS. 11A to 11C illustrate the damper lock 28. The damper lock 28 has a through hole 28*a* formed, into which a spring pin is inserted for connecting the damper lock 28 to the damper base 22. The damper lock 28 rotates in the vertical plane around the through hole 28*a* as a seesaw. On the upper surface at the end in the closing direction of the damper lock 28, a slider side hook 28*b* is formed which engages with a side 14*g*-1 in an opposite direction to the closing direction of the recess 14*g* of the slider 14 (see FIG. 6D). In the lower-side center part of the damper lock 28 in the longitudinal direction, a base side hook 28*c* is formed that engages with a side 12*d*-1 in an opposite direction to the closing direction of the lock hole 12*d* of the base 12 (see FIG. 5C).

Figure 12:
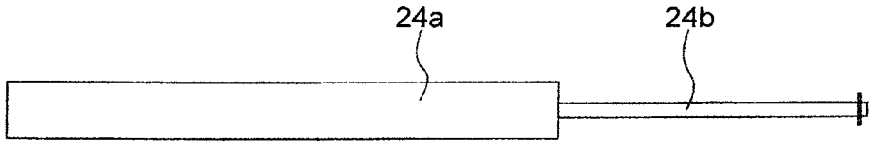
FIG. 12 is a side view of a linear damper.

FIG. 12 illustrates the linear damper 24. The linear damper 24 has the tubular damper main body 24*a* and the rod 24*b* that is extendable relative to the damper main body 24*a*. In the damper main body 24*a*, a piston (not shown) is provided to be connected to the rod 24*b*. The damper main body 24*a* is filled with oil. With extension and contraction of the rod 24*b*, the piston moves in the damper main body and viscous resistance of the oil causes a damping force. The piston sometimes has an orifice for passage of the oil.

Figure 13A:
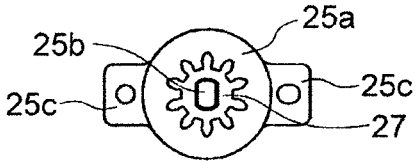
FIGS. 13A to 13C illustrate a rotary damper
Figure 13C:
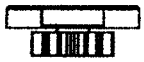
Figure 13B:
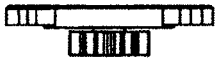

FIGS. 13A to 13C illustrate the rotary damper 25. The rotary damper 25 has the disc-shaped damper main body 25*a*, the rotation axis 25*b* rotatable relative to the damper main body 25*a* and the pinion 27 connected to the rotation axis 25*b*. The damper main body 25*a* is filled with oil. The rotation axis 25*b* is connected to the rotor (not shown). When the rotor rotates in the damper main body 25*a*, viscous resistance of the oil causes a damping force. In the damper main body 25*a*, a pair of overhanging parts 25*c* is formed which are connected to the damper base 22.

Figures 14A, 14B, 14C:
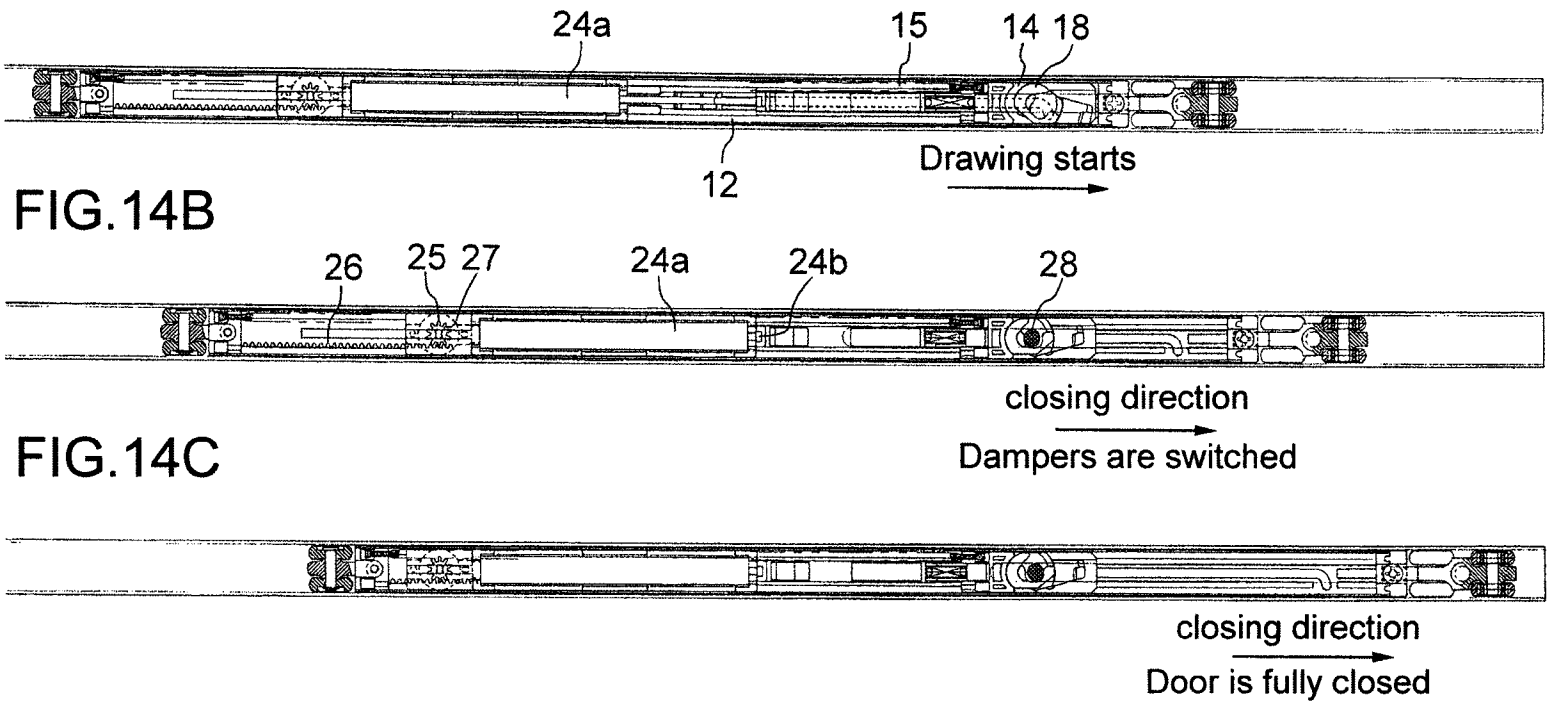
FIGS. 14A to 14C are plan views for explaining the operation of the drawing device when the sliding door gets closed

Next description is made about the operation of the drawing device when the sliding door 1 gets closed. FIGS. 14A to 14C are plan views of the drawing device and FIGS. 15A to 15C are cross sectional views of the drawing device. FIGS. 14A and 15A illustrate the drawing device which starts to draw, FIGS. 14B and 15B illustrate the drawing device when the dampers are changed, and FIGS. 14C and 15C illustrate the drawing device when the door is closed fully.

When the sliding door 1 is moved in the closing direction manually, the drawing device main body 4 moves in the closing direction together with the sliding door 1. As illustrated in FIGS. 14A and 15A, when the slider 14 reaches the drawing start position, the trigger catcher 18 abuts to the trigger pin 8. Then, the trigger catcher 18 rotates to catch the trigger pin 8, the slider 14 becomes slidable relative to the base 12. As the pulling coil spring 15 is provided between the slider 14 and the base 12, it causes such a pulling force as to slide the slider 14. As the trigger catcher 18 catches the trigger pin 8 fixed to the guide rail 2, the base 12 moves in the closing direction without moving the trigger catcher 18.

With movement of the base 12 in the closing direction, the sliding door 1 starts to move in the closing direction, and therefore, the force for closing the sliding door 1 is reduced. Then, as the rod 24*b* moves in the direction of the damper main body 24*a* of the linear damper 24, there occurs a larger damping force by the linear damper 24. As the linear damper 24 operates at the initial operation time where the spring force of the pulling coil spring 15 is large and the larger damping force is generated, movement of the sliding door 1 can be smoothed.

FIGS. 16(1-1) to (4-2) are detail views in which the trigger catcher 18 rotates to allow sliding. FIGS. 16 (1-1), (2-1), (3-1), (4-1) illustrate the trigger catcher 18 before it rotates and FIGS. 16(1-2), (2-2), (3-2), (4-2) illustrate the trigger catcher 18 after it has rotated. FIG. 16(1-1) and (1-2) at the top stage are plan views of the trigger pin 8 and the trigger catcher 18, FIGS. 16(2-1) and (2-2) at the second stage from the above are plan views of the trigger catcher 18, FIGS. 16(3-1) and (3-2) at the third stage from the above illustrate a state where the trigger catcher 18 is removed and FIGS. 16(4-1) and (4-2) at the bottom stage illustrate a state where the trigger catcher 18 and the malfunction reset cam 20 are removed.

As illustrated in FIGS. 16(1-1) and (1-2), when the trigger pin 8 abuts to the trigger catcher 18, the trigger catcher 18 rotates.

As illustrated in FIGS. 16(2-1) and (2-2), with rotation of the trigger catcher 18, the locking piece 18*b* of the trigger catcher 18 gets out of the locking groove 12*b*-2 of the base 12 and the locking slit 14*a*-2 of the slider 14.

As illustrated in FIGS. 16(3-1) and (3-2), with rotation of the trigger catcher 18, the malfunction reset cam 20 rotates. The open angle of the sector-shaped opening 20*a* of the malfunction reset cam 20 is larger than the locking piece 18*b*, the rotation angle of the malfunction reset cam 20 becomes smaller than the trigger catcher 18. Accordingly, if the malfunction reset cam 20 rotates, it does not run off the slider 14.

As illustrated in FIGS. 16(4-1) and (4-2), with rotation of the trigger catcher 18, the trigger pusher 19 that supports the rotation axis 18*a* of the trigger catcher 18 goes back to the direction opposite to the closing direction and shortens the compression coil spring 21.

Returning to FIGS. 14B and 15B, when the base 12 reaches the damper switching position, the rod 24*b* is accommodated in the damper main body 24*a* completely and the damping force due to the linear damper 24 disappears. At the same time, the slider 14 rotates the damper lock 28 against the spring force of the spring pin and engagement between the damper lock 28 and the base 12 is released. The rotated damper lock 28 enters the recess 14*g* of the slider 14 and the base 12 starts to move in the closing direction of the sliding door 1 relative to the damper base 22. At the end of the damper base 22 in the direction opposite to the closing direction, the rotary damper 25 is provided. Therefore, the rack 26 provided in the base 12 and the pinion 27 of the rotary damper 25 engage with each other, and the rotary damper 25 rotates. The rotation of the rotary damper 25 causes a damping force. Even after the operation of the linear damper 24, it is switched to the rotary damper 25 and the rotary damper 25 causes a damping force until the sliding door 1 is closed fully. This makes it possible to prevent occurrence of impact and noise during the full closing operation. As the pulling force of the pulling coil spring 15 becomes small at a last half of the drawing operation, it does not matter if the damping force generated by the rotary damper 25 is small.

Finally, as illustrated in FIGS. 14C and 15C, the sliding door is fully closed.

Figures 17A, 17B, 17C, 17D:
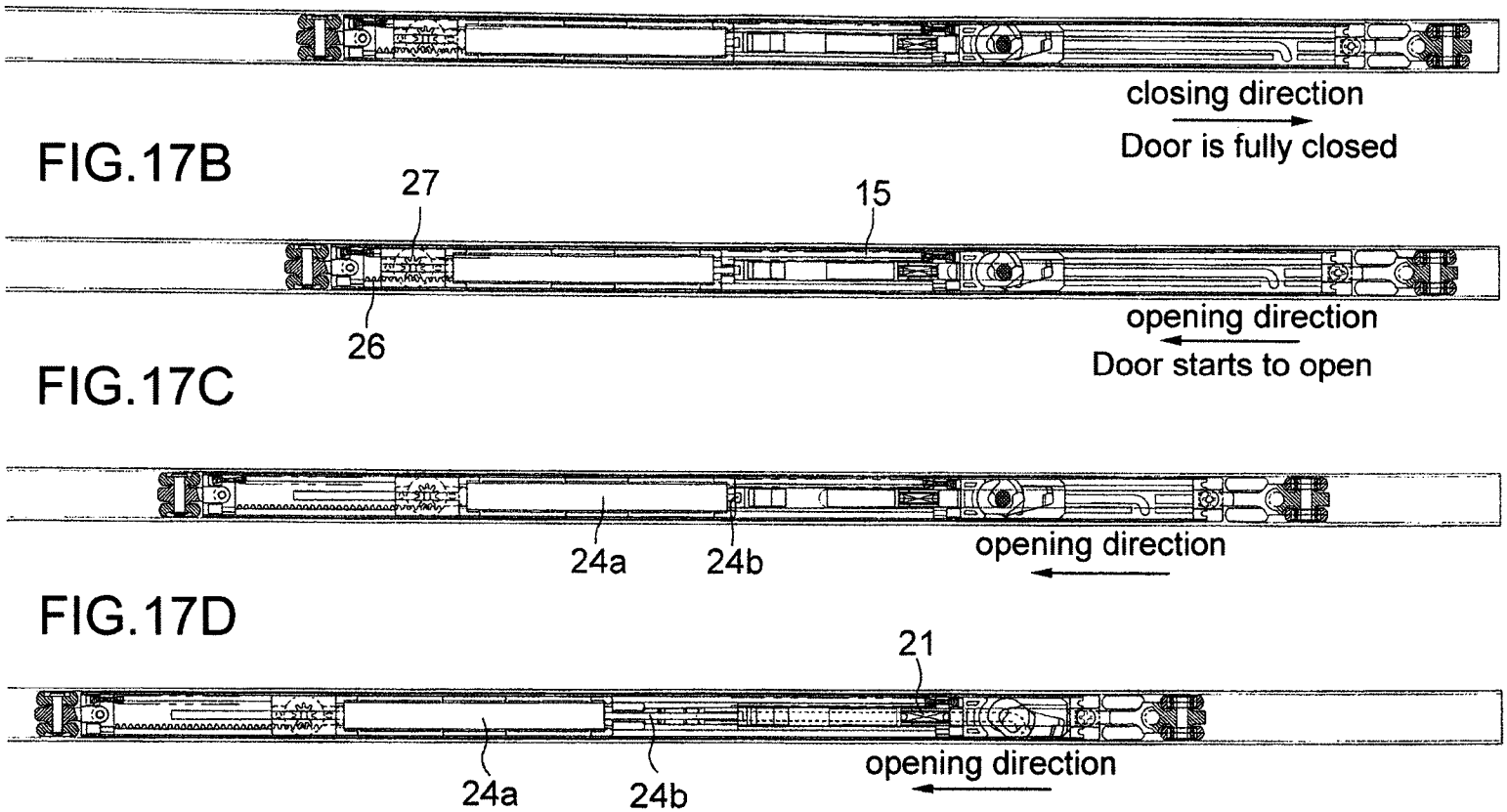
FIGS. 17A to 17D are plan views for explaining the operation of the drawing device when the sliding door gets open
Figures 18A, 18B, 18C, 18D:
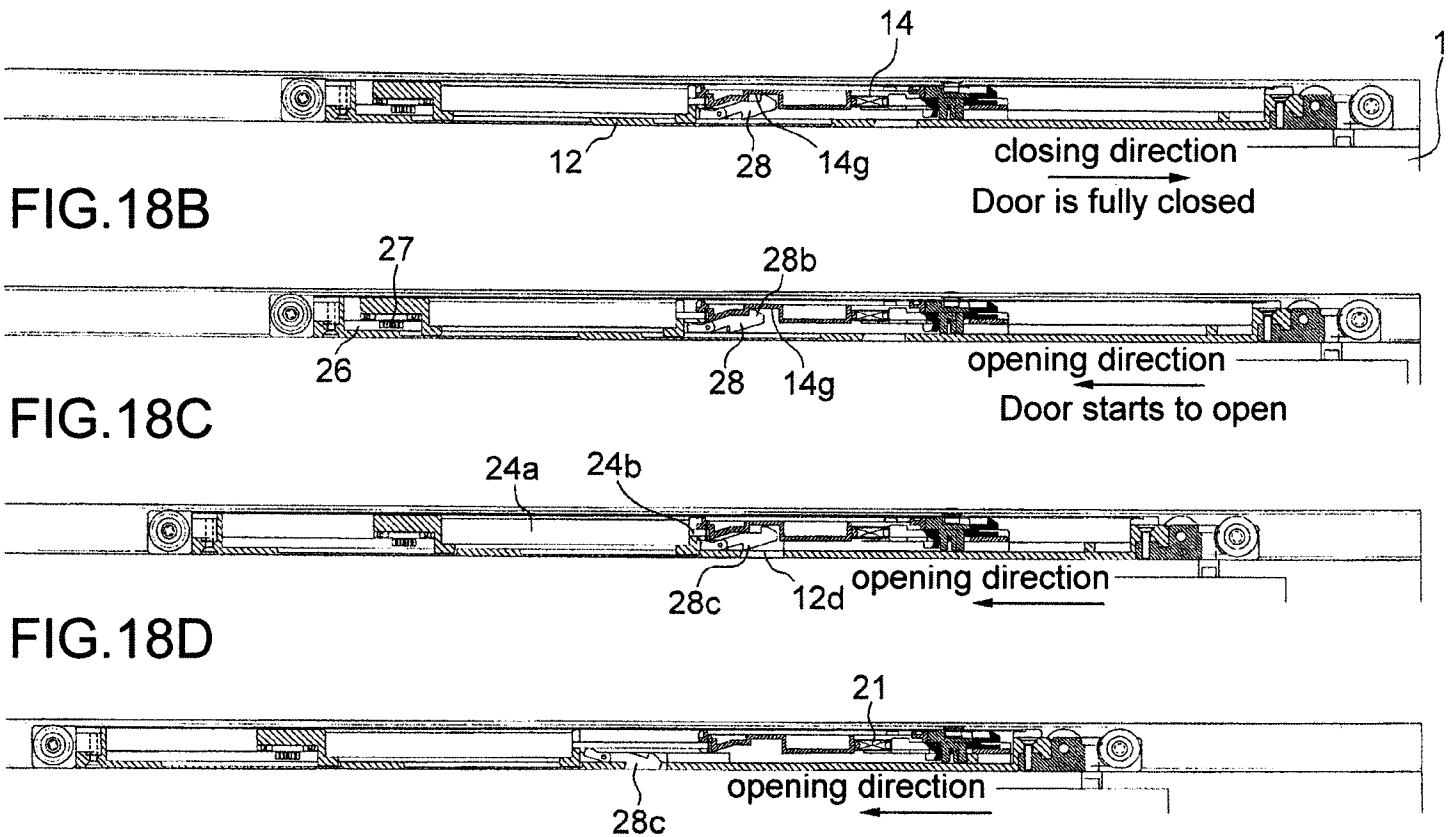
FIGS. 18A to 18D are cross sectional views for explaining the operation of the drawing device when the sliding door gets open

Next description is made about the operation of the drawing device when the sliding door opens. FIGS. 17A to 17D are plan views of the drawing device and FIGS. 18A to 18D are cross sectional views of the drawing device. FIGS. 17A and 18A illustrate the drawing device when the sliding door is fully closed, FIGS. 17B and 18B illustrate the drawing device when the sliding door starts to open, FIGS. 17C and 18C illustrate the drawing device when the damper lock is fit in the lock hole of the base 12 and FIGS. 17D and 18D illustrate the drawing device when the damper base 22 moves integrally with the base 12.

As illustrated in FIGS. 17A and 18A, when the sliding door 1 is fully closed, the damper lock 28 is fit in the recess 14*g* of the slider 14 and the base 12 can move relative to the slider 14 with movement of the sliding door 1.

As illustrated in FIG. 18B, when the sliding door 1 starts to open, the slider side hook 28*b* of the damper lock 28 engages with the recess 14*g* of the slider 14, and the base 12 moves in the opening direction relative to the damper base 22 and the slider 14. Then, the pinion 27 of the rotary damper 25 rotates while it engages with the rack 26 provided in the base 12. As the rotary damper 25 is set not to cause the damping force in the rotational direction when the sliding door 1 opens, the load applied when opening the sliding door 1 is only an elastic force that is generated by extending of the pulling coil spring 15.

As illustrated in FIG. 18C, when the lock hole 12*d* of the base 12 moves to the damper lock position, the base side hook 28*c* of the damper lock 28 is fit in the lock hole 12*d* by the spring force of the spring pin and the damper base 22 moves integrally with the base 12. As the base 12 moves in the opening direction of the sliding door 1, the rod 24*b* is drawn from the damper main body 24*a* of the linear damper 24.

As illustrated in FIGS. 17D and 18D, the rod 24*b* is completely drawn from the damper main body 24*a* of the linear damper 24 and the slider 14 moves up to the lock position of the base 12, the trigger catcher 18 and the malfunction reset cam 20 rotate by the elastic force of the compression coil spring 21 and the slider 14 is fixed to the lock position. Then, as the trigger catcher 18 releases the trigger pin 8, the sliding door is moved without operating of the drawing device.

The present invention is not limited to the above-described embodiments but may be modified in various forms without departing from the scope of the present invention. For example, the drawing device of the present invention may be used to assist closing and opening of the opening/closing body such as folding door, drawer, as well as the sliding door. In the above-mentioned embodiment, the trigger catcher and the slider are separate members, but they may be combined into one piece.

The present invention is not limited to the above described embodiments, and various variations and modifications may be possible without departing from the scope of the present invention.

This application is based on the Japanese Patent application No. 2010-038301 filed on Feb. 24, 2010, entire content of which is expressly incorporated by reference herein.

What is claimed is:

1. A drawing device for imparting a biasing force in one direction to an opening and closing body movable relative to a frame when the opening and closing body moves in the one direction, comprising:

a trigger pin attached to one of the frame and the opening and closing body; and a drawing device main body attached to the other of the frame and the opening and closing body, provided for catching the trigger pin to impart to the opening and closing body the biasing force in the one direction, the drawing device main body comprising:

a base, a slider with a trigger catcher capable of catching the trigger pin wherein the slider is slidable relative to the base in a longitudinal direction after the trigger catcher has caught the trigger pin, an elastic member, disposed between the base and the slider, which imparts the biasing force so as to move the slider relative to the base in the longitudinal direction, and a damper mechanism which generates a damping force when the slider is biased relative to the base in the longitudinal direction by the elastic member, the damper mechanism comprising:

a linear damper with a rod extendable relative to a damper main body, a rotary damper with a rotation axis rotatable relative to the damper main body, and a damper base provided in the base and slidable in a longitudinal direction, to which one of the rod and the damper main body of the linear damper is mounted, and to which one of a rack engaged with a pinion of the rotation axis of the rotary damper and the damper main body of the rotary damper is mounted, wherein the other of the damper main body and the rod of the linear damper is mounted to the slider, and the other of the damper main body of the rotary damper and the rack engaged with the pinion of the rotation axis is mounted to the base, and wherein, when the slider moves relative to the base in the longitudinal direction by the biasing force of the elastic member, first the damper base moves relative to the slider causing the rod of the linear damper to contract so that the linear damper causes a first damping force, then the base moves relative to the damper base and the slider, and the pinion of the rotary damper rotates to cause a second damping force.

2. The drawing device of claim 1, wherein the damping mechanism includes a damper lock which is provided in the damper base, and which engages with the base so as to prevent the damper base from sliding relative to the base in the longitudinal direction and releases engagement with the base so as to make the damper base slidable relative to the base in the longitudinal direction, and wherein, when the slider moves relative to the base in the longitudinal direction by the biasing force of the elastic member, first the damper base engaged with the base by the damper lock moves relative to the slider, and then, the damper lock and the base are disengaged, the base moves relative to the damper base and the slider.

3. The drawing device of claim 2, wherein the damper lock is provided in the damper base to be rotatable, a damper lock engaging piece is formed in the base that engages with the damper lock, when the slider moves relative to the base in the longitudinal direction, the slider rotates the damper lock which is in engagement with the damper lock engaging piece, and thereby the damper lock and the base are disengaged.

* * * * *